US009587197B2

(12) United States Patent
Duncan et al.

(10) Patent No.: US 9,587,197 B2
(45) Date of Patent: Mar. 7, 2017

(54) ADDITIVE COMPOSITIONS AND INDUSTRIAL PROCESS FLUIDS

(71) Applicant: Fuchs Petrolub SE, Mannheim (DE)

(72) Inventors: Michael P. Duncan, Aurora, IL (US); D. James Deodhar, St. Charles, IL (US); Gema del Olmo Tomás, Sant Joan Despi (ES); Heinz Gerhard Theis, Westheim (DE); Paul Roger Littley, Alsager (GB)

(73) Assignee: FUCHS PETROLUB SE, Mannheim (DE)

( * ) Notice: Subject to any disclaimer, the term of this patent is extended or adjusted under 35 U.S.C. 154(b) by 0 days.

(21) Appl. No.: 14/434,917

(22) PCT Filed: Feb. 3, 2014

(86) PCT No.: PCT/US2014/014453
§ 371 (c)(1),
(2) Date: Apr. 10, 2015

(87) PCT Pub. No.: WO2015/116233
PCT Pub. Date: Aug. 6, 2015

(65) Prior Publication Data

US 2016/0201000 A1 Jul. 14, 2016

(51) Int. Cl.

| | |
|---|---|
| ***C10M 133/06*** | (2006.01) |
| ***C10M 133/10*** | (2006.01) |
| ***C10M 133/44*** | (2006.01) |
| ***C10M 173/00*** | (2006.01) |
| ***C10M 135/04*** | (2006.01) |
| ***C10M 137/04*** | (2006.01) |
| ***C10M 145/00*** | (2006.01) |
| ***C10M 169/04*** | (2006.01) |

(52) U.S. Cl.
CPC ..... *C10M 133/44* (2013.01); *C10M 135/04* (2013.01); *C10M 137/04* (2013.01); *C10M 145/00* (2013.01); *C10M 169/04* (2013.01); *C10M 169/044* (2013.01); *C10M 173/00* (2013.01); *C10M 2201/02* (2013.01); *C10M 2203/1006* (2013.01); *C10M 2203/1025* (2013.01); *C10M 2203/1065* (2013.01); *C10M 2205/0285* (2013.01); *C10M 2207/125* (2013.01); *C10M 2215/04* (2013.01); *C10M 2215/042* (2013.01); *C10M 2215/086* (2013.01); *C10M 2215/28* (2013.01); *C10M 2219/104* (2013.01); *C10M 2223/04* (2013.01); *C10M 2223/043* (2013.01); *C10N 2230/06* (2013.01); *C10N 2230/12* (2013.01); *C10N 2230/44* (2013.01); *C10N 2230/64* (2013.01)

(58) Field of Classification Search
CPC ..... C10M 133/06; C10M 133/10
USPC ..... 508/545, 513; 72/42
See application file for complete search history.

(56) References Cited

U.S. PATENT DOCUMENTS

| | | | | |
|---|---|---|---|---|
| 3,945,931 | A * | 3/1976 | Bussi | C10M 173/02 508/435 |
| 3,966,619 | A * | 6/1976 | Smith | C10M 173/02 252/389.21 |
| 4,089,792 | A * | 5/1978 | Lowe | C10M 1/08 252/400.21 |
| 4,670,172 | A * | 6/1987 | Sproul | C10M 173/02 508/511 |
| 5,401,428 | A * | 3/1995 | Kalota | C10M 173/02 508/508 |
| 5,763,372 | A | 6/1998 | Tersigni et al. | |
| 5,916,852 | A * | 6/1999 | Nibert | C10M 141/10 508/419 |
| 5,985,803 | A | 11/1999 | Rizvi et al. | |
| 6,605,575 | B1 * | 8/2003 | Yamato | C10M 111/04 508/501 |
| 6,648,929 | B1 | 11/2003 | Daly et al. | |
| 6,706,670 | B2 * | 3/2004 | Kalota | C10M 173/02 508/185 |
| 8,822,392 | B1 * | 9/2014 | Loper | C10M 133/44 508/291 |
| 2004/0214733 | A1 * | 10/2004 | Baba | C10M 141/10 508/430 |
| 2006/0223720 | A1 * | 10/2006 | Sullivan | C10M 141/10 508/433 |
| 2006/0223721 | A1 * | 10/2006 | Sullivan | C10M 141/10 508/433 |
| 2006/0264337 | A1 | 11/2006 | Wenderoth et al. | |
| 2010/0105590 | A1 * | 4/2010 | Nagakari | C10M 141/00 508/508 |
| 2012/0058925 | A1 | 3/2012 | Takagi et al. | |
| 2012/0202728 | A1 * | 8/2012 | Garcia Ojeda | C10M 163/00 508/545 |

(Continued)

FOREIGN PATENT DOCUMENTS

| | | |
|---|---|---|
| EP | 2 520 639 | 11/2012 |

OTHER PUBLICATIONS

International Search Report and Written Opinion of the International Searching Authority received in Patent Application No. PCT/US2014/014453 mailed Nov. 3, 2014, 10 pages.

(Continued)

*Primary Examiner* — Ellen McAvoy
(74) *Attorney, Agent, or Firm* — Foley & Lardner LLP

(57) ABSTRACT

A processing fluid that is free of boron and secondary amines includes a petroleum-based or non-petroleum-based oil; water; and an additive composition comprising a long chain primary amine; an tertiary cycloalkylamine; and an amino acid.

24 Claims, No Drawings

(56) References Cited

U.S. PATENT DOCUMENTS

2015/0024985 A1* 1/2015 Loper ..... C10M 169/04
508/291

OTHER PUBLICATIONS

Examination Report No. 1 received in Australian Patent Application No. 2014321172, 3 pages.
Official Action issued on Japanese Application 2015-560187, mailed Feb. 22, 2016, English translation provided.
Preliminary Rejection received for Korean Patent Application No. 10-2015-7016666 issued Oct. 23, 2015, 4 pages—with English translation.

* cited by examiner

ADDITIVE COMPOSITIONS AND INDUSTRIAL PROCESS FLUIDS

CROSS-REFERENCE TO RELATED APPLICATIONS

The present application is the U.S. National Stage of PCT/US2014/014453, filed on Feb. 3, 2014, the entire contents of which are incorporated herein by reference in their entirety.

FIELD

The present technology is generally related to additive compositions and industrial processing fluids. In particular, the present technology is related to environmentally friendly metal-working, metal-forming, forging, and mining fluids.

BACKGROUND

Metal-working fluids and metal-forming fluids are used extensively throughout the machine manufacturing or machining industry for their cooling, lubrication, and corrosion resistant properties during operations such as metal cutting, grinding, boring, drilling, turning, forming, ironing, coining, stamping, and drawing. Such fluids are typically made of complex mixtures of oils, detergents, surfactants, biocides, lubricants, anti-corrosion agents, and other potentially harmful ingredients. For example, commercial fluids may incorporate additives such as boric acid, alkali borates, and borate esters in combination with alkanolamines for maintaining alkaline pH values, and for neutralizing acidic functional components in metal-working fluids and metal-forming fluids.

While the fluids are essential for metal forming and machining, they are currently being examined with increased scrutiny because of hazards associated with worker exposure, including but not limited to skin rashes, possible increased cancer rates, respiratory problems and other issues. The fluids may pose substantial environmental problems associated with their disposal. There is now universal agreement on the need for safer more environmentally friendly functional fluids.

SUMMARY

In one aspect, an additive composition is provided. The additive compositions include a long chain primary amine; a tertiary cycloalkylamine and an amino acid; wherein the processing fluid is boron-free and free of a secondary amine. The additive composition is adapted for use in water based industrial processing fluids leading to enhanced lubricating characteristics, anti-corrosion and buffering capability. Furthermore, a processing fluid containing the additive composition is less harmful for the environment and exhibit less negative health implications for workers compared to conventional fluids due being boron-free and free of secondary amines. In any of the embodiments of the additive composition, the long chain primary amine may be a $C_8$-$C_{24}$ primary amine. For example, the long chain primary amine may include octylamine, nonylamine, decylamine, undecylamine, dodecylamine, tridecylamine, tetradecylamine, pentadecylamine, hexadecylamine, heptadecylamine, or octadecylamine. In any of the embodiments of the additive composition, the tertiary cycloalkylamine may be an ethoxylated tertiary cycloalkylamine including di(ethanol)cyclopentylamine, di(ethanol)cyclohexylamine, di(ethanol)cycloheptylamine, dicyclopentyl(ethanol)amine, or dicyclohexyl (ethanol)amine. In any of the embodiments of the additive composition, the amino acid may be of the formula $NH_2CHR^2CO_2H$, wherein $R^2$ is H, alkyl, or aryl. For example, the amino acid may include alanine, arginine, asparagine, aspartic acid, cysteine, glutamine, glutamic acid, glycine, histidine, isoleucine, leucine, lysine, methionine, phenyalanine, proline, serine, threonine, tryptophan, tyrosine, or valine.

In another aspect, a processing fluid is provided. The processing fluids include a petroleum-based or non-petroleum-based oil; water; a long chain primary amine; a tertiary cycloalkylamine; and an amino acid; wherein the processing fluid is boron-free and free of a secondary amine. In any of the embodiments of the processing fluid, the long chain primary amine may be a $C_8$-$C_{24}$ primary amine. For example, the long chain primary amine may include octylamine, nonylamine, decylamine, undecylamine, dodecylamine, tridecylamine, tetradecylamine, pentadecylamine, hexadecylamine, heptadecylamine, or octadecylamine. In any of the embodiments of the processing fluid, the tertiary cycloalkylamine may be an ethoxylated tertiary cycloalkylamine including di(ethanol)cyclopentylamine, di(ethanol)cyclohexylamine, di(ethanol)cycloheptylamine, dicyclopentyl(ethanol)amine, or dicyclohexyl(ethanol)amine. In any of the embodiments of the processing fluid, the amino acid may be of the formula $NH_2CHR^2CO_2H$, wherein $R^2$ is H, alkyl, or aryl. For example, the amino acid may include alanine, arginine, asparagine, aspartic acid, cysteine, glutamine, glutamic acid, glycine, histidine, isoleucine, leucine, lysine, methionine, phenyalanine, proline, serine, threonine, tryptophan, tyrosine, or valine.

In some embodiments of the processing fluid, it includes the petroleum-based oil. In other embodiments of the processing fluid, it includes the non-petroleum-based oil. In further embodiments of the processing fluid, it includes a mixture of petroleum and non-petroleum-based oils.

In any of the embodiments of the processing fluid, one or more of the following additives may be included: an alkanolamine, a polymerized fatty acid, a phosphate ester, an ethoxylated fatty amine, a hydrocarbyl succinimide, a sulfur-containing compound, an aliphatic carboxylic acid, an aliphatic dicarboxylic acid, a defoaming agent, a corrosion inhibitor, or an olfactory agent.

In any of the embodiments of the processing fluid, the fluid may have a pH that is basic. For example, the pH of the processing fluid may be 9 or greater.

The processing fluids may be used in a wide variety of applications including, but not limited to, metal-working fluids, metal-forming fluids, forging fluids, and mining fluids. Accordingly, in some embodiments, a metal-working fluid includes any of the above processing fluids. In other embodiments, a metal-forming fluid includes any of the above processing fluids. In other embodiments, a forging fluid includes any of the above processing fluids. In other embodiments, a mining fluid includes any of the above processing fluids.

DETAILED DESCRIPTION

Various embodiments are described hereinafter. It should be noted that the specific embodiments are not intended as an exhaustive description or as a limitation to the broader aspects discussed herein. One aspect described in conjunction with a particular embodiment is not necessarily limited to that embodiment and can be practiced with any other embodiment(s).

As used herein, "about" will be understood by persons of ordinary skill in the art and will vary to some extent depending upon the context in which it is used. If there are uses of the term which are not clear to persons of ordinary skill in the art, given the context in which it is used, "about" will mean up to plus or minus 10% of the particular term.

The use of the terms "a" and "an" and "the" and similar referents in the context of describing the elements (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the embodiments and does not pose a limitation on the scope of the claims unless otherwise stated. No language in the specification should be construed as indicating any non-claimed element as essential.

In general, "substituted" refers to replacement of one or more hydrogen atoms of a molecule with non-hydrogen atoms or a group of atoms. Substituents consisting of at least two or more atoms may contain multiple bonds, including double or triple bonds, as well as one or more heteroatom(s), i.e. atoms other than hydrogen and carbon atoms, like nitrogen, oxygen, etc. for example. Examples of substituent groups include: hydroxyls; alkoxy, alkenoxy, alkynoxy, aryloxy, aralkyloxy, heterocyclyloxy, and heterocyclylalkoxy groups; carbonyls (oxo); carboxyls; esters; urethanes; oximes; hydroxylamines; alkoxyamines; aralkoxyamines; thiols; sulfides; sulfoxides; sulfones; sulfonyls; sulfonamides; amines; N-oxides; hydrazines; hydrazides; hydrazones; azides; amides; ureas; amidines; guanidines; enamines; imides; isocyanates; isothiocyanates; cyanates; thiocyanates; imines; nitro groups; and the like.

As used herein, "alkyl" groups include straight chain and branched alkyl groups having from 1 to about 20 carbon atoms, and typically from 1 to 12 carbons or, in some embodiments, from 1 to 8 carbon atoms. As employed herein, "alkyl groups" include cycloalkyl groups as defined below. Alkyl groups may be substituted or unsubstituted. Examples of straight chain alkyl groups include methyl, ethyl, n-propyl, n-butyl, n-pentyl, n-hexyl, n-heptyl, and n-octyl groups. Examples of branched alkyl groups include, but are not limited to, isopropyl, sec-butyl, t-butyl, neopentyl, and isopentyl groups. Representative substituted alkyl groups may be substituted one or more times with, for example, amino, thio, hydroxy, or alkoxy groups.

Cycloalkyl groups are cyclic alkyl groups such as, but not limited to, cyclopropyl, cyclobutyl, cyclopentyl, cyclohexyl, cycloheptyl, and cyclooctyl groups. Cycloalkyl groups may be substituted or unsubstituted. Cycloalkyl groups further include polycyclic cycloalkyl groups such as, but not limited to, norbornyl, adamantyl, bornyl, camphenyl, isocamphenyl, and carenyl groups, and fused rings such as, but not limited to, decalinyl, and the like. Cycloalkyl groups also include rings that are substituted with straight or branched chain alkyl groups as defined above. Representative substituted cycloalkyl groups may be mono-substituted or substituted more than once, such as, but not limited to: 2,2-; 2,3-; 2,4-; 2,5-; or 2,6-disubstituted cyclohexyl groups or mono-, di-, or tri-substituted norbornyl or cycloheptyl groups, which may be substituted with, for example, alkyl, alkoxy, amino, thio, hydroxy, cyano, and/or halo groups.

As used herein, "free of boron" or "boron-free" indicates that boron is only present at trace levels. This may include where the composition contains less than 0.5 wt % boron. In some embodiments, this may include where the composition contains less than 0.1 wt % boron, or less than 0.05 wt % boron. As used herein, "free of secondary amines" or "secondary amine-free" indicates that secondary amines are present only at trace level amounts. This may include where the composition contains less than 0.5 wt % of secondary amines. In some embodiments, this may include where the composition contains less than 0.1 wt % secondary amines, or less than 0.05 wt % secondary amines.

Provided herein are water-miscible industrial processing fluids. As used herein, the term water-miscible refers to a fluid that can mix with water. The processing fluids are intended to be environmentally compatible replacements for current state of the art fluids used in a variety of applications, including as metal-working and metal-forming fluids. The processing fluids provided are free of boron and secondary amines and possess no or a low amount of volatile organic components (VOCs). The processing fluids should generally be innocuous to metal workers and others that may come into contact with the fluids.

The processing fluids are base fluids that may be incorporated into a wide range of products used in industrial lubricants and processes, including but not limited to the metal-working, cutting, grinding, and metal-forming industries. Alternatively, the processing fluids may be used as process cleaners, water-based hydraulic fluids, and mining fluids. The water-miscible processing fluids may be used in a aqueous-based lubricants such as, but not limited to, soluble oils containing greater than 50 wt % mineral oil and which form emulsions with a particle size of greater than 1 μm when diluted with water; semi-synthetic lubricants with a typical emulsion particle size of 0.5 to 1 μm and which contain less than 50 wt % mineral oil; micro-emulsions (i.e. emulsions have a particle size of less than 0.5 μm) that contain less than 5 wt % mineral oil and that exist as microscopic droplets in water; neo-synthetic lubricants that are mineral oil free, but may contain up to 30 wt % or more of vegetable oils, animal oils, animal fats, natural esters, synthetic esters, polyglycols, and/or synthetic polyolefins that carry water insoluble materials as microscopic droplets in water; and true solution synthetic oils where all of the additives are soluble in water.

The water-miscible processing fluids are suitable for use as a lubricating agent in the machining and forming of metals such as, but not limited to, steel, aluminum, titanium, and their alloys. The processing fluids do not, or only minimally, corrode, stain or discolor such metals. The processing fluids provide anti-corrosion properties, and buffer other aqueous industrial fluids. Furthermore, when residual amounts remain on the surfaces of worked or formed metals, the residues do not hamper or negatively impact additional processes such as heat treatment, welding, coating and/or painting.

In one aspect, a processing fluid is provided, the processing fluid being free of boron and secondary amines. The processing fluids includes a petroleum-based or non-petroleum-based oil; water; a long chain primary amine, a tertiary cycloalkylamine, in particular an ethoxylated tertiary cycloalkylamine, and an amino acid. The processing fluid may be water-miscible.

In some embodiments, the processing fluid includes the petroleum-based oil. Illustrative petroleum-based oils include, but are not limited to, refined naphthenic oil and paraffinic oil. Mixtures of any two or more such oils may also be used in the processing fluids.

In some embodiments, the processing fluid includes the non-petroleum-based oil. Illustrative non-petroleum-based oils include, but are not limited to, vegetable oils, synthetic esters, poly alpha olefins, polyalkylene glycols, and fatty oils such as triglycerides of vegetable or animal origin. Mixtures of any two or more such oils or mixture with any of the petroleum-based oils may also be used in the processing fluids.

The long chain primary amine may be a $C_8$-$C_{24}$ primary amine, according to some embodiments. Illustrative long chain primary amines include, but are not limited to, octylamine, nonylamine, decylamine, undecylamine, dodecylamine, tridecylamine, tetradecylamine, pentadecylamine, hexadecylamine, heptadecylamine, or octadecylamine. The processing fluid may include mixtures of any two or more such long chain primary amines.

Illustrative ethoxylated tertiary cycloalkylamines include, but are not limited to, di(ethanol)cyclopentylamine, di(ethanol)cyclohexylamine, di(ethanol)cycloheptylamine, dicyclopentyl(ethanol)amine, or dicyclohexyl(ethanol)amine. In some embodiments, the ethoxylated tertiary cycloalkylamine is di(ethanol)cyclohexylamine.

The long chain primary amine may be present in the processing fluid in an amount from about 1 wt % to about 5 wt %. In some embodiments, the long chain primary amine is present in the processing fluid from about 2 wt % to about 4 wt %. The ethoxylated tertiary cycloalkylamine may be present in the processing fluid in an amount from about 1 wt % to about 5 wt %. In some embodiments, the ethoxylated tertiary cycloalkylamine is present in the processing fluid from about 2 wt % to about 4 wt %.

As noted, the processing fluids include an amino acid. It is believed that the amino acids provide good emulsifying properties to the fluids and aid in dispersability and stability of emulsions. For example, the amino acid may be a proteinogenic (alpha) amino acid. Illustrative amino acids may be of any one of Formulas $NH_2CHR^2CO_2H$, $NH_2CH_2CHR^2CO_2H$, or $NH_2CHR^2CH_2CO_2H$, where $R^2$ is H or alkyl. In some embodiments, $R^2$ is H or a $C_1$-$C_4$ alkyl. Illustrative amino acids may include, but are not limited to, alanine, arginine, asparagine, aspartic acid, cysteine, glutamine, glutamic acid, glycine, histidine, isoleucine, leucine, lysine, methionine, phenyalanine, proline, serine, threonine, tryptophan, tyrosine, or valine. Any two or more such amino acids may be used in the processing fluids. In any of the above embodiments, the amino acid may be glycine, lysine, aspartic acid, or a mixture of any two or more such amino acids. The amino acid may be present in the processing fluid in an amount from about 1 wt % to about 5 wt %. In some embodiments, the amino acid is present in the processing fluid from about 2 wt % to about 4 wt %.

In some embodiments, the processing fluids include an alkanolamine. Illustrative alkanolamines include, but are not limited to, methanolamine, ethanolamine, propanolamine, trimethanolamine, triethanolamine, tripropanolamine, methyldimethanolamine, ethyldimethanolamine, propyldimethanolamine, cyclohexyldimethanolamine, methyldiethanolamine, ethyldiethanolamine, or propyldiethanolamine. Mixtures of any two or more such alkanolamines may be used in the processing fluids.

The alkanolamines may be present in the processing fluid in an amount from about 1 wt % to about 15 wt %. In some embodiments, the alkanolamine is present in the processing fluid from about 5 wt % to about 10 wt %.

As noted, the processing fluids include a polymerized fatty acid. The polymerized fatty acid may be a material such as, but not limited to, a polymerized ricinoleic acid derived from castor oil or polymerized fatty acids derived from soy bean oil, or linseed oil.

Any of the above processing fluids may also include a phosphate ester. Phosphate esters may be used as pressure, anti-wear and/or corrosion-inhibiting agents. Where the fluid includes a phosphate ester it is a compound of formula $[R^4(CH_2CH_2O)_n]_aP(O)[OX]_b$. In the formula, $R^4$ is $C_6$-$C_{30}$ alkyl, phenyl, ($C_1$-$C_{10}$ alkyl)phenyl, or ($C_1$-$C_{10}$ dialkyl) phenyl; X is H, ammonium, tetraalkylammonium, amines, or a metal that is Li, Na, K, Rb, Cu, Ag, Au, Be, Mg, Ca, Sr, Ba, Zn, Cd, and Hg. Additionally, in the formula, n is from 0 to 50; a is 1, 2, or 3; and b is 0, 1, or 2, such that the sum of a and b is 3. In some embodiments, the phosphate ester is a polyethylene glycol monooleyl ether phosphate, polyethylene glycol mono $C_{12}$-$C_{15}$ alcohol ether phosphate, or polyethylene glycol mono $C_{10}$-$C_{14}$ alcohol ether phosphate.

In some embodiments, the fluid includes an ethoxylated fatty amine that is the reaction product of ethylene oxide and a fatty amine, the ethoxylated fatty amine having the formula $R^3N[(CH_2CH_2O)_mH][(CH_2CH_2O)_nH]$. Ethoxylated fatty amines exhibit surfactant-like characteristics and are used typically as emulsifiers and/or wetting agents. In the formula, $R^3$ is cocoalkyl ($C_{12}$, $C_{14}$ saturated), tallow ($C_{16}$, $C_{18}$ saturated and $C_{18}$ unsaturated), stearyl ($C_{18}$ saturated), and oleyl ($C_{18}$ monounsaturated); and m and n are from about 2 to about 20. In some embodiments, the ethoxylated fatty amine is a polyoxyethylene cocoamine, bis-(2-hydroxyethyl) isotridecyloxypropylamine or N-tallow-poly(3) oxyethylene-1,3-diaminopropane.

Any of the above processing fluids may also include a hydrocarbyl succinimide. Such additives may be used as dispersants and/or detergents in the processing fluids. The hydrocarbyl succinimide may include the reaction product of polyisobutylene of molecular weight from about 500 to about 3000 Daltons and maleic anhydride.

Any of the above processing fluids may also include a sulfur-containing compound. Sulfur-containing compounds, in conjunction with the above phosphate esters, may act as high pressure agents, anti-wear agents, and corrosion-inhibiting agents. Illustrative sulfur-containing compounds may include, but are not limited to, elemental sulfur, a sulfurized mineral oil, or a compound of formula:

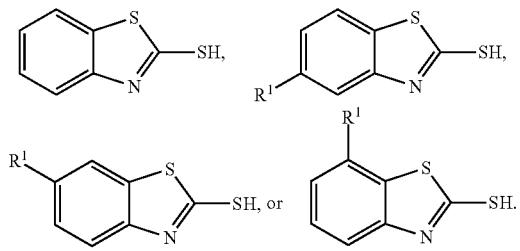

In such formulae, $R^1$ is H, $SO_4$, $NH_2$, $CH_3$, COOH, $OCH_3$, or $OCH_2CH_3$. In processing fluids that contain both a sulfur-containing compound and a phosphate ester, the weight ratio of the phosphate ester to the sulfur in the sulfur-containing compound may be from about 25:1 to about 1:1.

Any of the above processing fluids may also include an aliphatic carboxylic acid or an aliphatic dicarboxylic acid. These types of additives are typically used as corrosion inhibitors, lubricity agents and/or emulsifiers when neutralized with appropriate alkanolamines. The aliphatic mono- or di-carboxylic acid may be a $C_6$-$C_{25}$ mono- or di-carboxylic acid, according to various embodiments. Illustrative mono- and di-carboxylic acids for use in the processing fluids include, but are not limited to, hexanoic, heptanoic, octanoic, caprylic, isononaoic, neodecanoic, azelaic, decanoic, undecanoic, sebacic, nonanonic, dodecanoic, tetradecanoic, hexadecanoic, octadecanoic, eicosanoic, dodecenoic acid, tetradecenoic acid, hexadecenoic, octadecenoic, eicosaenoic, docosenoic, octadecatrienoic, octanedioic, nonanedioic, ricinoleic, decanedioic, undecanedioic, dodecanedioic, tridecanedioic, tetradecanedioic, pentadecanedioic, hexadecanedioic, heptadecanedioic, octadecanedioic, nonadecanedioic, eicosanedioic, docosanedioic, behenic, abietic, or erucic acid.

Any of the above processing fluids may also include a variety of further additives including, but not limited to defoaming agents, corrosion inhibitors, or olfactory agents.

As will be noted, the processing fluids are aqueous-based fluids. The water content of the fluids may range across a wide spectrum. In any of the above embodiments, the water may be present from about 1 wt % to about 50 wt %. In other embodiments, the water is present from about 1 wt % to about 25 wt %. In other embodiments, the water is present from about 25 wt % to about 50 wt %. In other embodiments, the water is present from about 20 wt % to about 50 wt %. In other embodiments, the water is present from about 25 wt % to about 35 wt %. The processing fluids also have a basic pH. This may include a pH of greater than 7. In any of the above embodiments, the pH of the processing fluid is at least 9. For example, the pH of the processing fluids may be from 9 to 12.

In an illustrative embodiment, the processing fluid may include any one or more of the following, and, when included (the materials are not required), the amount the material may be present in:

A hydrocarbyl succinimide in an amount of about 1 wt % to about 10 wt % based on the industrial fluid, in some embodiments from about 3 wt % to about 5 wt %;

An alkanolamine in an amount of about 1 wt % to about 15 wt % based on the industrial fluid, in some embodiments from about 5 wt % to about 10 wt %;

A mixed $C_7$-$C_{25}$ fatty acid in an amount of about 1 wt % to about 10 wt % based on the industrial fluid, in some embodiments from about 2 wt % to about 7 wt %;

A polymerized fatty acid derived from $C_{15}$-$C_{22}$ fatty acids in an amount of about 1 wt % to about 5 wt % based on the industrial fluid, in some embodiments from about 1 wt % to about 3 wt %;

Mono- and/or dibasic $C_7$-$C_{25}$ acids in an amount of about 0.5 wt % to about 5 wt % based on the industrial fluid, in some embodiments from about 1 wt % to about 3 wt %;

A phosphate ester in an amount of about 1 wt % to about 10 wt % based on the industrial fluid, in some embodiments from about 2 wt % to about 4 wt %;

An ethoxylated fatty amine in an amount of about 0.5 wt % to about 3 wt % based on the industrial fluid, in some embodiments from about 0.7 wt % to about 1.5 wt %;

Glycerine in an amount of about 0.5 wt % to about 3 wt % based on the industrial fluid, in some embodiments from about 0.7 wt % to about 1.5 wt %;

A defoamer in an amount of about 0.5 wt % to about 3 wt % based on the industrial fluid, in some embodiments from about 0.7 wt % to about 1.5 wt %;

A corrosion inhibitor in an amount of about 0.1 wt % to about 1 wt % based on the industrial fluid, in some embodiments from about 0.15 wt % to about 0.5 wt %;

A alkanolamine fatty acid soap as water-soluble lubricity agent in which the fatty acid moieties are derived from $C_6$-$C_{22}$ fatty acids, in some embodiments from about 10 wt % to about 15 wt %;

A Sulfur-containing compound with a weight ratio of the phosphate ester to the sulfur-containing compound being in a range of from about 25:1 to about 1:1 based on the weight of sulfur in said sulfur-containing compound; and A base oil in an amount sufficient to make up the balance of the composition, i.e. in an amount of about 20 wt % to about 60 wt % based on the industrial fluid, in some embodiments from about 30 wt % to about 40 wt %.

In an illustrative embodiment, the processing fluid may include:

| Component | Example | wt % |
|---|---|---|
| Long chain aliphatic primary amine | Tridecylamine | 1-5 |
| Alpha amino acid | Glycine, lysine, and/or aspartic acid | 1-5 |
| Ethoxylated cyclic tertiary amine | diethanolcyclohexylamine | 1-5 |
| Sum of above components | | Σ = 5-15 |
| Hydrocarbyl succinimides | PIBSA | 1-10 |
| Alkanolamines | Ethanolamine and/or isopropanolamine | 1-15 |
| Fatty acids | neodecanoic and/or erucic fatty acid | 1-10 |
| Polymerised fatty acid | polymerised ricinoleic acid | 0.5-5 |
| Mono- and/or dibasic acids | C10 and C11 dibasic acid | 0.5-5 |
| Phosphate ester | Polyoxyethylene octadecenyl ether phosphate | 1-10 |
| Ethoxylated fatty amines | Polyoxyethylene-15-cocoamine | 0.5-3 |
| Glycerine | glycerine | 0.5-3 |
| Defoamer | Non-silicone type | 0.5-3 |
| Corrosion inhibitor | Benzotriazole | 0.1-1 |
| water | | 10-50 |
| base oil | | balance (20-60) |

The present invention, thus generally described, will be understood more readily by reference to the following examples, which are provided by way of illustration and are not intended to be limiting of the present invention.

EXAMPLES

Example 1 pH Stability Testing

A forming fluid was prepared based upon the formula presented in Table 1, by combination of the materials.

Amine Mixture 3 is a mixture of 3-amino-4-octanol and 2-amino-2-methyl-1-propanol Aliphatic primary amine is selected from 1 or more of the following: nonylamine, decylamine, undecylamine, dodecylamine, tridecylamine, tetradecylamine, pentadecylamine, hexadecylamine, heptadecylamine, or octadecylamine Alpha Amino Acid is selected from one or more of the following: alanine, aspartic acid, cysteine, glutamine, glutamic acid, glycine, leucine, lysine, methionine, phenylamine, proline, tryptophan, tyrosine, or valine.

Alkanolamine Mixture is a mixture of monoethanolamine, monoisopropylamine, and triethanolamine.

TABLE 1

Fluid Formulations

| | Example | | | | | | | | | | |
|---|---|---|---|---|---|---|---|---|---|---|---|
| Material | 1 | 2 | 3 | 4 | 5 | 7 | 8 | 22 | 23 | 24 | 26 |
| DCHA | 6 | | | | | | | | | 6 | |
| MDCHA | | 3.5 | | | | | | | | | |
| Amine Mix. 1 | | | 6 | | | | | | | | |
| Amine Mix 2 | | | | 6 | | | | | | | |
| Amine Mix 3 | | | | | 6 | | | | | | |
| Aliphatic Primary Amine | | | | | | 3 | 3 | 3 | 3 | | 3 |
| Alpha Amino Acid | | | | | | 3 | | 3 | 3 | | 3 |
| 2-Amino-2-methyl-1-propanol | | | | | | | | | | 3 | |
| Cyclohexylamine 2EO | | | | | | | | 2 | 3 | | |
| Boric Acid | 2 | 2 | | | 2 | | | | | 2 | |
| Lactic Acid | | | | | | | 2 | | | | |
| Alkanolamine mixture | 12.5 | 12.5 | 13 | 13 | 12.5 | 12.5 | 12.5 | 7.5 | 6.5 | 17.5 | 9.5 |
| Fatty Acid Mixture 1 | 5 | 5 | 5 | 5 | 5 | 5 | 5 | 5 | 5 | 1 | 5 |
| Adconate Emulsifier | 5 | 5 | 5 | 5 | 5 | 5 | 5 | 5 | 5 | 8 | 5 |
| Benzotriazole | 0.3 | 0.3 | 0.3 | 0.3 | 0.3 | 0.3 | 0.3 | 0.3 | 0.3 | 0.3 | 0.3 |
| Fatty Acid Mixture 2 | 4 | 4 | 4 | 4 | 4 | 4 | 4 | 4 | 4 | 4 | 4 |
| PET (4) Oleyl Ether Phosphate | 3 | 3 | 3 | 3 | 3 | 3 | 3 | 3 | 3 | 5 | 3 |
| Tripropylene glycol monomethyl ether | | | | | | | | | | 7 | |
| Cocoamine 1580 | 1 | 1 | 1 | 1 | 1 | 1 | 1 | 1 | 1 | | 1 |
| Naphthenic Oil | 40 | 46.2 | 40 | 40 | 40 | 40 | 40 | 38 | 38 | 44 | 38 |
| Water | 20.7 | 17 | 22.2 | 22.2 | 20.7 | 22.7 | 23.7 | 27.7 | 27.7 | 1.7 | 27.7 |
| Defoaming Agent | 0.5 | 0.5 | 0.5 | 0.5 | 0.5 | 0.5 | 0.5 | 0.5 | 0.5 | 0.5 | 0.5 |
| Total | 100 | 100 | 100 | 100 | 100 | 100 | 100 | 100 | 100 | 100 | 100 |
| pH Stability (Delta) | 0.3 | 0.7 | 0.6 | 0.6 | 0.3 | 0.2 | 0.9 | | | | |
| pH Stability Rating | Good | Poor | Fair | Fair | Good | Excellent | Poor | | | | |
| Al Tap Torque (AMVT) | | | | | | | | 202 | 183 | 215 | |
| Al Tap Torque Rating | | | | | | | | Good | Excellent | Fair | |
| Ti Tap Torque (AMVT) | | | | | | | | | 176 | 206 | |
| Ti Tap Torque Rating | | | | | | | | | Excellent | Good | |
| Residue Characteristics | Partly fluid/tacky, slow, incomplete wash off | | | | | | | | Soft/partly fluid, quick wash-off, no residue | Partly fluid/tacky, slow, incomplete wash off | Soft/partly fluid, slow, but no residue after wash off |
| Residue Rating | Fair | | | | | | | | Excellent | Fair | Good |

In Table 1, the following definitions apply:

DCHA is an abbreviation for dicyclohexylamine.

MDCHA is an abbreviation for methyldicyclohexylamine.

Amine Mixture 1 is a mixture of dicyclohexylamine and dibutylaminoethanol.

Amine Mixture 2 is a mixture of methyldicyclohexylamine, dibutylaminoethanol, and methyldiethanolamine.

Fatty Acid Mixture 1 is a mixture of tall oil fatty acid, neodecanoic acid, and dibasic acid.

Fatty Acid Mixture 2 is a mixture of polymerized ricinoleic acid, high erucic acid, and ricinoleic acid.

With regard to the results presented in Table 1, a number of conclusions may be drawn. First, when the working fluid samples of Example 7, containing the synergistic combination of the long chain aliphatic amine and the proteinogenic amino acid, were employed, the pH stability of the emulsion at the working concentration was excellent. In contrast, the pH stability of the other emulsion samples as tested under the same conditions appeared inferior.

Second, when the working fluid samples of Example 23, containing the synergistic combination of the long chain aliphatic amine, the proteinogenic amino acid, and the cyclic amine, the tap torque at the working concentration was low, providing excellent lubrication characteristics on aluminum alloys. In contrast, the lubrication characteristics, as measured by tap torque tests under the same test conditions of the other emulsion samples, appeared inferior.

Third, when the working fluid samples of Example 23 were tested, the tap torque at the working concentration was low, providing excellent lubrication characteristics on titanium alloys. In contrast, the lubrication characteristics, as measured by tap torque tests under the same test conditions of the other emulsion samples, appeared inferior.

Fourth, the working fluid samples of Example 23 exhibited excellent residue formation and subsequent wash-off characteristics at the working concentration. In contrast, the residue and wash-off characteristics of the other emulsion samples as tested under the same conditions appeared inferior.

In comparing the formulation of Example 23 was compared to another lubricant fluid from Fuchs (ECOCOOL® 761B). The results are presented in Table 2.

TABLE 2

Comparison Testing of the Formulation from Example 23.

| Test | Example 23 | ECOCOOL ® 761B |
|---|---|---|
| pH Stability[1] | Superior to ECOCOOL ® 761B | Acceptable |
| Skin irritancy[2] | Pass | Pass |
| Lubricity[3] | — | — |
| Aluminum | 199 | 208 |
| Steel | 288 | 277 |
| Titanium | 176 | 230 |
| Lubricity Test[4] (Machine tool test) | Superior to ECOCOOL ® 761B | Acceptable |
| Airbus performance tests[5] | Superior to ECOCOOL ® 761B | Acceptable |
| FLC product release tests | — | — |
| Emulsion Stability[6] | stable to 1000 ppm | stable to 1000 ppm |
| Foam control[7] | low foam | low foam |
| Corrosion control[8] | no corrosion @2% | no corrosion at 2.5% |
| Ferrous | No rust @ 2% | Light rust at 2% |
| Aluminum. | No stain on all alloys | No stain on all alloys |
| Titanium | No stain | No stain |
| Detergency[9] | — | — |
| Tramp oil rejection[10] | Good | Good |
| Residue solubility[11] | Superior to ECOCOOL ® 761B | Acceptable |
| Recirculation study[12] | low foam - no degradation of emulsion over 2 months | low foam - some instability |
| Concentrate stability[13] | Stable | Stable |
| Physical properties | — | — |
| pH | 9.43 | 9.3 |
| Total alkalinity | 54 | 30 |
| Specific gravity | 0.98 | 0.98 |
| Odor | Coolant odor | Coolant odor |
| Chloride content | <20 ppm | <20 ppm |

[1]PH stability: Emulsions of each fluid were prepared in duplicate at a concentration of 10% in the presence of a slice of agar. A single inoculation of a microbial suspension was added and incubated at 25° C. for a period of 14 days. The stability of the emulsion was evaluated by measuring the difference in pH values between the start and the end of the test.

[2]TEWL. Trans Epidermal Water Loss (TEWL) is a term associated with dermatology and connected sciences. It is defined as the measurement of the quantity of water that passes from inside a body through the epidermal layer (skin) to the surrounding atmosphere fia diffusion and evaportation processes.

TABLE 2-continued

Comparison Testing of the Formulation from Example 23.

| Test | Example 23 | ECOCOOL ® 761B |
|---|---|---|

[3]FLC mircotap torque test. Lower value indicates better lubricity. Machining Performance. Performance.

Aluminum: Mircotap tests were run on each product, diluted to a concentration of 10% vol.%. All aluminum tests were run on pre-drilled holes on Aluminum 6061 bars.

[4]Machine tool - Fuchs UK. This test was conducted on machine tool test equipment at Fuchs UK based on an OEM Aerospace metal working test protocol. The method is based on milling titanium alloy using a solid carbide end mil. Tool wear is measured under a stereo microscope at 5 minutes intervals of cutting until the tool reaches a high wear level and the cutting edges of the tool break up. From this the tool life can be drived and is quoted in munutes of cutting. Tool data: Sandvik 16 mm End mill R216.24 16050IAK32P1620. Substrate: Ti6Al-4V, Grade 5 ASTM B348. Test conditions: RPM - 2337 rpm; Feed - 972 mm/min; Axial depth of cut - 10.0 mm; Radial depth of cut - 1.0 mm; Length of cut - 740 mm; Lead in radius - 10.0 mm; Lead out radius - 10.0 mm.

[5]The Airbus performance test was conducted as per ABR 9-0204.

[6]Emulsion Stability: The product was mixed at 5% in (1) tap water (125 ppm Ca), (2)water with 500 ppm Ca, (3)water with 500 ppm Mg, and (4)water with 1,000 ppm Ca, and all samples were left to stand 24 hours. The product is considered unsuitable at the demonstrated water hardness when a precipitate forms at the bottom or scumming is seen at the top. Performance Evaluation: Excellent (stable in all hardness (1), (2), (3), (4)); Good (stable in (1), (2) and (3)); and Fair (stable in (1) and (2)).

[7]Foam Control: Test - 300 ml of emulsion was prepared at 5% in tap water (125 ppm Ca), and blended for 1 minuted at high speed in a Waring Blender. The fluid is immediately poured into a 1000 ml graduated cylinder, and the foam height is measured. The foam height was measured again 2 minutes agrer cessation of blending. Performance Evaluation: Excellent foam control (<20 ml foam); Good (<50 ml foam); and Fair (<100 ml foam).

[8]Cast Iron Corrosion: Product is mixed at the indicated concentrations (1, 2, 3, and 4%) in tap water (<25 ppm chloride). The mixtures are then applied to ASTM cast iron chips and placed upon filter paper, covered for 2 hours, then the is cover removed and the mixture allowed to dry overnight. Performance Evaluation: Excellent (2% exhibits no rust); Good (3% exhibits no rust); and Fair (4% exhibits no rust).

[9]Non Ferrous Staining: Non-ferrous specimens were mechancially sanded, stored in acetone then immersed in product mixed at 10% in Tap Water (~120 ppm hardness) for 20 hours.

[10]Tramp Oil Rejection: 95 mL of product is mixed at 5% in tap water (125 ppm Ca) with 5 mL of hydraulic fluid (Renolin AW 68), then blended for 1 minute at high speed in a Waring blender. The fluid is immediately poured into a 100 ml graduated cylinder and allowed to sit for 24 hours. A reading is made of the oil and cream on top of the fluid. Performance Evaluation: Excellent tramp rejection performance (3 ml of an oil layer and 1 ml of cream layer); Good (2 ml of an oil layer and 1 ml of cream layer).

[11]Residue Wash-off Test. 50 ml of a 5 emulsion of product in tap water (Ca 125 ppm) is placed into a petri dish in an oven at 48.8° C. for 24 hours. The residue appearance after 24 hours is recorded, then washed off under a tap with cold water. Performance evaluation: Excellent (soft/partly fluid, quick wah-off, no residue); Good (soft/partly fluid, slow, but, no residue after wash-off); and Fair (partly fluid/tacky, slow, incomplete, wash-off).

[12]FLC test #. Recirculation Test: This is a test to determine how a product will perform in a recirculating machining sump. A 10% dilution of product in deionized water (2 L) is placed in a 4 liter beaker. Using pumps and hoses, the product is then recirculated. Every 30 minutes 100 ppm hardness is added to a total of 300 ppm of hardness (as Calcium). The fluid is then recirculated every day(shutting down at night) for 3 weeks. Performance evaluation: Excellent (the emulsion is stable throughout test, low foam. No instability or insoluble soap formation); Good (some emulsion instability, moderate foam and insoluble soap formation); Fair (moderate instability, increased foam and insoluble soap formation); and Poor (emulsion splitting, high foam and heavy insoluble soap formation.

[13]Concentrate Stability: 20 ml of product is placed into 3 separate vials, then different vials are inserted into a) an oven set at 48.8° C. and b) a refrigerator set at 4.4° C. and c) a freezer set at -18° C. The vials are checked each day for concentrate stability. The sample in the freezer is taken out each day and allowed to warm to room temperature before recording stability. The stability testing is typically performed for 5 days. Any visual separation, drop-out or haze are considered instability issues. RESULT: Product exhibits excellent concentrate stability with very slight darkening in oven. The product will freeze hard but upon returning to room temperature is bright and clear v/o requiring agitation.

Based upon the data presented in Table 2, the formulation provided in Example 23 is comparable to in some respects, and significantly better than in other respects, state of the art coolants. For example, with regard to lubricity, titanium machining, residual material, and Airbus performance, the formulation of Example 23 is superior to the state of the art.

In Table 2, the following are parameters for the tests are provided:

Titanium: Mircotap tests were run on each product, diluted to a concentration of 20% vol. %. All titanium tests were run on pre-drilled holes on Titanium bars. All tests were conducted on a Megatap II Micro-electronische Gerate GMBH.

| | Metal | |
|---|---|---|
| | Aluminum | Titanium |
| Work Piece | Al alloy 6061 | Titanium TIG % - F |
| Tap | HY 6020 YMW Japan, M6X1 D8P HSS-E | HSSE - TICM; M6-6XL; Emuge Germany |

-continued

| | Metal | |
|---|---|---|
| | Aluminum | Titanium |
| Tapping Conditions | | |
| Speed (rpm) | 1000 | 300 |
| Test Depth (mm) | 10 | 14 |
| Holes Tapped per run | 6 | 20 |
| Evaluation (Average Mean Value Torque (AVMVT) | | |
| Excellent | <190 NCm | <190 NCm |
| Good | <205 NCm | <205 NCm |
| Fair | <215 NCm | <230 NCm |
| Poor | >215 NCm | >230 NCm |

While certain embodiments have been illustrated and described, it should be understood that changes and modifications can be made therein in accordance with ordinary skill in the art without departing from the technology in its broader aspects as defined in the following claims.

The embodiments, illustratively described herein may suitably be practiced in the absence of any element or elements, limitation or limitations, not specifically disclosed herein. Thus, for example, the terms "comprising," "including," "containing," etc. shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

The present disclosure is not to be limited in terms of the particular embodiments described in this application. Many modifications and variations can be made without departing from its spirit and scope, as will be apparent to those skilled in the art. Functionally equivalent methods and compositions within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can of course vary. It is also to be understood that the terminology used herein is for the purpose of describing particular embodiments only, and is not intended to be limiting.

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like, include the number recited and refer to ranges which can be subsequently broken down into subranges as discussed above. Finally, as will be understood by one skilled in the art, a range includes each individual member.

All publications, patent applications, issued patents, and other documents referred to in this specification are herein incorporated by reference as if each individual publication, patent application, issued patent, or other document was specifically and individually indicated to be incorporated by reference in its entirety. Definitions that are contained in text incorporated by reference are excluded to the extent that they contradict definitions in this disclosure.

Other embodiments are set forth in the following claims.

What is claimed is:

1. An additive composition comprising:
a long chain primary amine;
a tertiary cycloalkylamine; and
an amino acid;
wherein the additive composition is boron-free and free of a secondary amine.

2. The additive composition of claim 1, wherein the long chain primary amine is a $C_8$-$C_{24}$ primary amine.

3. The additive composition of claim 1, wherein the tertiary cycloalkylamine is an ethoxylated tertiary cycloalkylamine selected from the group comprising di(ethanol)cyclopentylamine, di(ethanol)cyclohexylamine, di(ethanol)cycloheptylamine, dicyclopentyl(ethanol)amine, and/or dicyclohexyl(ethanol)amine.

4. The additive composition of claim 1, wherein the amino acid is of the formula $NH_2CHR^2CO_2H$, wherein $R^2$ is H or alkyl.

5. The additive composition of claim 1, wherein the amino acid is alanine, arginine, asparagine, aspartic acid, cysteine, glutamine, glutamic acid, glycine, histidine, isoleucine, leucine, lysine, methionine, phenyalanine, serine, threonine, tryptophan, tyrosine, or valine.

6. The additive composition of claim 1, wherein the amino acid is alanine, arginine, asparagine, cysteine, glutamine, glutamic acid, glycine, histidine, isoleucine, leucine, lysine, methionine, phenyalanine, serine, threonine, tryptophan, tyrosine, or valine.

7. A processing fluid comprising:
a petroleum-based or non-petroleum-based oil;
water;
a long chain primary amine;
a tertiary cycloalkylamine; and
an amino acid;
wherein the processing fluid is boron-free and free of a secondary amine.

8. The processing fluid of claim 7, wherein the long chain primary amine is a $C_8$-$C_{24}$ primary amine.

9. The processing fluid of claim 7, wherein the long chain primary amine comprises octylamine, nonylamine, decylamine, undecylamine, dodecylamine, tridecylamine, tetradecylamine, pentadecylamine, hexadecylamine, heptadecylamine, or octadecylamine.

10. The processing fluid of claim 7, wherein the tertiary cycloalkylamine is an ethoxylated tertiary cycloalkylamine selected from di(ethanol)cyclopentylamine, di(ethanol)cyclohexylamine, di(ethanol)cycloheptylamine, dicyclopentyl (ethanol)amine, or dicyclohexyl(ethanol)amine.

11. The processing fluid of claim 7, wherein the amino acid is of the formula $NH_2CHR^2CO_2H$, wherein $R^2$ is H, alkyl, or aryl.

12. The processing fluid of claim 7, wherein the amino acid is alanine, arginine, asparagine, aspartic acid, cysteine, glutamine, glutamic acid, glycine, histidine, isoleucine, leucine, lysine, methionine, phenyalanine, serine, threonine, tryptophan, tyrosine, or valine.

13. The processing fluid of claim 7 further comprising an alkanolamine comprising methanolamine, ethanolamine, propanolamine, trimethanolamine, triethanolamine, tripropanolamine, methyldimethanolamine, ethyldimethanolamine, propyldimethanolamine, cyclohexyldimethanolamine, methyldiethanolamine, ethyldiethanolamine, or propyldiethanolamine.

14. The processing fluid of claim 7 further comprising a polymerized fatty acid which is a polymerized ricinoleic acid derived from castor oil, or a polymerized fatty acid derived from soy bean oil, or a linseed oil.

15. The processing fluid of claim 7 comprising the petroleum-based oil.

16. The processing fluid of claim 7 comprising the non-petroleum-based oil.

17. The processing fluid of claim 7 further comprising a phosphate ester and/or an ethoxylated fatty amine.

18. The processing fluid of claim 7, wherein the water is present from about 1 wt % to about 50 wt %.

19. The processing fluid of claim 7 further comprising a hydrocarbyl succinimide.

20. The processing fluid of claim 7 further comprising a sulfur-containing compound.

21. The processing fluid of claim 7 comprising a sulfur-containing compound and a phosphate ester, wherein the weight ratio of the phosphate ester to the sulfur in the sulfur-containing compound is from about 25:1 to about 1:1.

22. The processing fluid of claim 7 further comprising an aliphatic carboxylic acid or an aliphatic dicarboxylic acid.

23. The processing fluid of claim 7 further comprising an additive comprising a defoaming agent, a corrosion inhibitor, or an olfactory agent.

24. The processing fluid of claim 7 having a pH of at least 9.

* * * * *